US007886395B2

(12) United States Patent
Farnworth et al.

(10) Patent No.: US 7,886,395 B2
(45) Date of Patent: Feb. 15, 2011

(54) PENCIL SHARPENER WITH ERASER

(75) Inventors: Stuart David Farnworth, Westport, CT (US); Jonathan A. Lee, Milford, CT (US); Javier Verdura, Milford, CT (US)

(73) Assignee: Acme United Corporation, Fairfield, CT (US)

( * ) Notice: Subject to any disclaimer, the term of this patent is extended or adjusted under 35 U.S.C. 154(b) by 456 days.

(21) Appl. No.: 11/899,533

(22) Filed: Sep. 6, 2007

(65) Prior Publication Data

US 2009/0067912 A1 Mar. 12, 2009

(51) Int. Cl.
*B43L 19/00* (2006.01)

(52) U.S. Cl. ..... 15/105.53; 15/425; 7/160; 30/451

(58) Field of Classification Search ..... 30/451–462; 7/124, 160; D19/53, 73; 15/424–434, 105.51, 15/105.53; 144/28.1–28.9
See application file for complete search history.

(56) References Cited

U.S. PATENT DOCUMENTS 84,655 A * 12/1868 Thompson ..... 206/37
144,364 A * 11/1873 Stackpole ..... 15/425
443,613 A * 12/1890 Fitch ..... 15/425
501,570 A * 7/1893 Lustnauer ..... 15/425
556,681 A * 3/1896 Landers ..... 15/425
660,072 A * 10/1900 Clark et al. ..... 7/124
829,327 A * 8/1906 Crisp ..... 15/425
961,141 A * 6/1910 Kingsbury ..... 15/425
967,946 A * 8/1910 Marshall ..... 15/105.53
970,984 A * 9/1910 Bryant ..... 15/105.53
1,067,012 A * 7/1913 Faber ..... 15/425
1,844,729 A * 2/1932 Wells ..... 15/105.53
2,276,047 A * 3/1942 Kurth ..... 401/88
D208,282 S * 8/1967 Speers ..... D9/710
4,066,109 A * 1/1978 Narang et al. ..... 144/28.11
4,759,441 A * 7/1988 Leurck ..... 206/373
D426,852 S * 6/2000 Gstalder ..... D19/73
D442,993 S * 5/2001 Eisen ..... D19/73
D466,940 S * 12/2002 Gstalder ..... D19/73
D469,125 S * 1/2003 Jacquet ..... D19/53

* cited by examiner

*Primary Examiner*—Laura M. Lee
(74) *Attorney, Agent, or Firm*—Alix, Yale & Ristas, LLP

(57) ABSTRACT

A pencil sharpener case has a rotatable cover which covers a mechanical pencil sharpener. In one position, the cover may be rotatably retracted to provide access to the pencil sharpener. The case also mounts an eraser which may be used when the pencil sharpener is covered.

8 Claims, 5 Drawing Sheets

PENCIL SHARPENER WITH ERASER

BACKGROUND

This application relates to manual handheld pencil sharpeners. More particularly, this application relates to handheld manual pencil sharpeners which employ a reservoir for retaining shavings.

SUMMARY OF THE DISCLOSURE

Briefly stated, a case which mounts a pencil sharpener and an eraser comprises a pair of shells. A first shell has a generally rounded shape with a first side portion which mounts a pencil sharpener. A generally opposite side portion of the shell mounts an eraser. A second rounded shell, which is rotatably mounted to the first shell, rotates from a first position wherein the second shell covers the pencil sharpener to a second position wherein the shell covers the eraser and allows the pencil sharpener to be accessed for usage.

The first shell defines a reservoir for receiving shavings from the pencil sharpener. The pencil sharpener in one embodiment has a pair of openings of different dimensions. The pencil sharpener is removable from the first shell to allow removal of the shavings. One of the shells has a detent and the other of the shells has a catch for detaining the shell in the first or second positions to permit usage of the pencil sharpener or the eraser. The first shell has a pair of indentations adjacent the pencil sharpener to facilitate removal.

In one embodiment, the first shell is formed from a pair of sections which interlock by means of at least one post and socket. The shell may define an opening wherein the eraser is retained to the first shell by a medial post portion which extends through an extension of the eraser. In one embodiment, there are three posts and corresponding openings and three extensions for anchoring the eraser which preferably has a rounded arcuate shape. The second shell may also have a soft overmold applied to one portion. One shell has a pair of opposing axles, and the other shell has a pair of opposing apertures which retain the axles to rotatably couple the shells.

DETAILED DESCRIPTION

Figure 1:
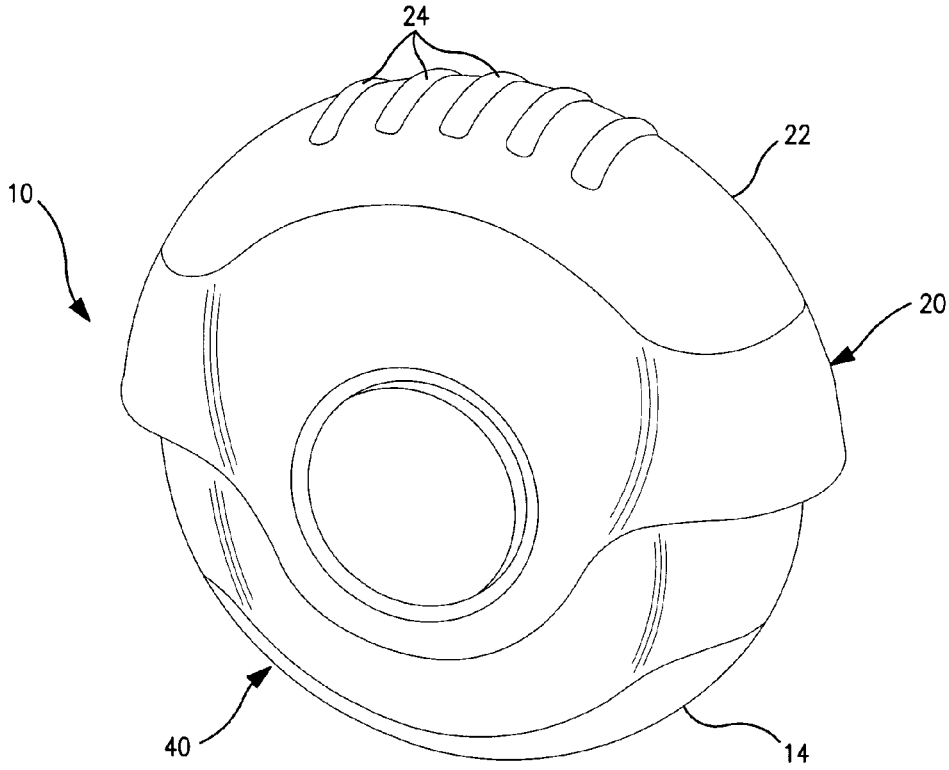
FIG. 1 is a perspective view of a pencil sharpener case.
Figure 2:
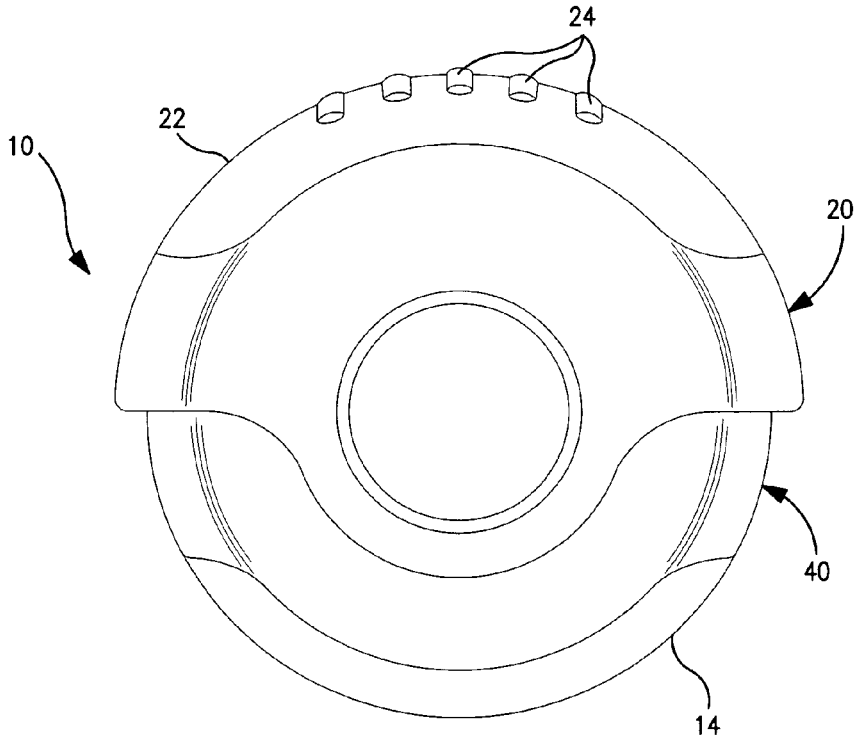
FIG. 2 is a front elevational view of the pencil sharpener case of FIG. 1.
Figure 3:
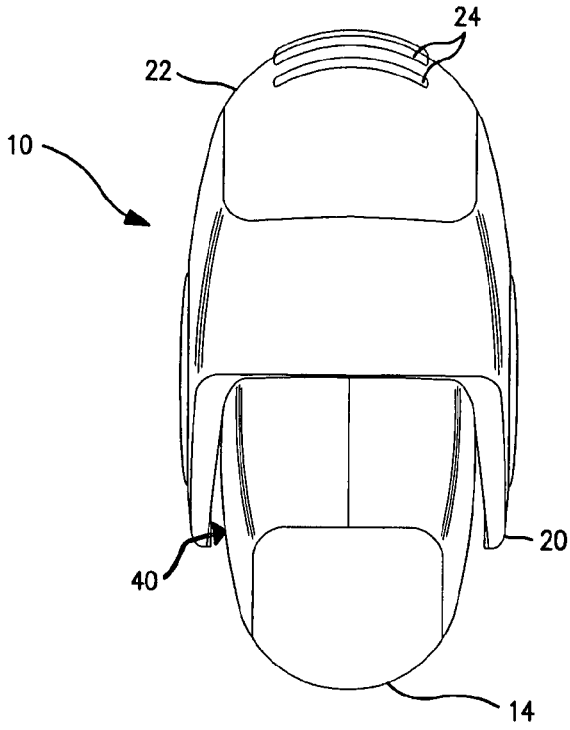
FIG. 3 is a side elevational view of the pencil sharpener case of FIG. 1.
Figure 4:
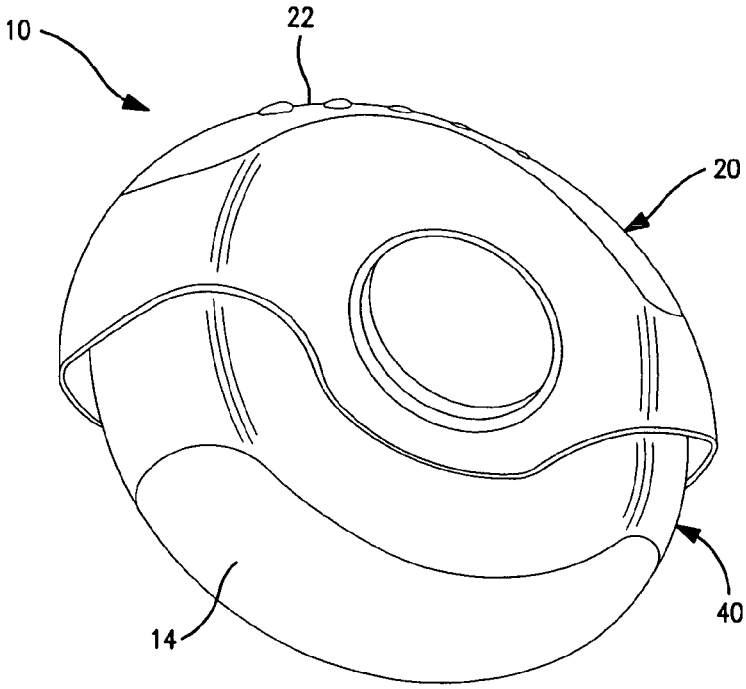
FIG. 4 is a bottom perspective view of the pencil sharpener case of FIG. 1.
Figure 5:
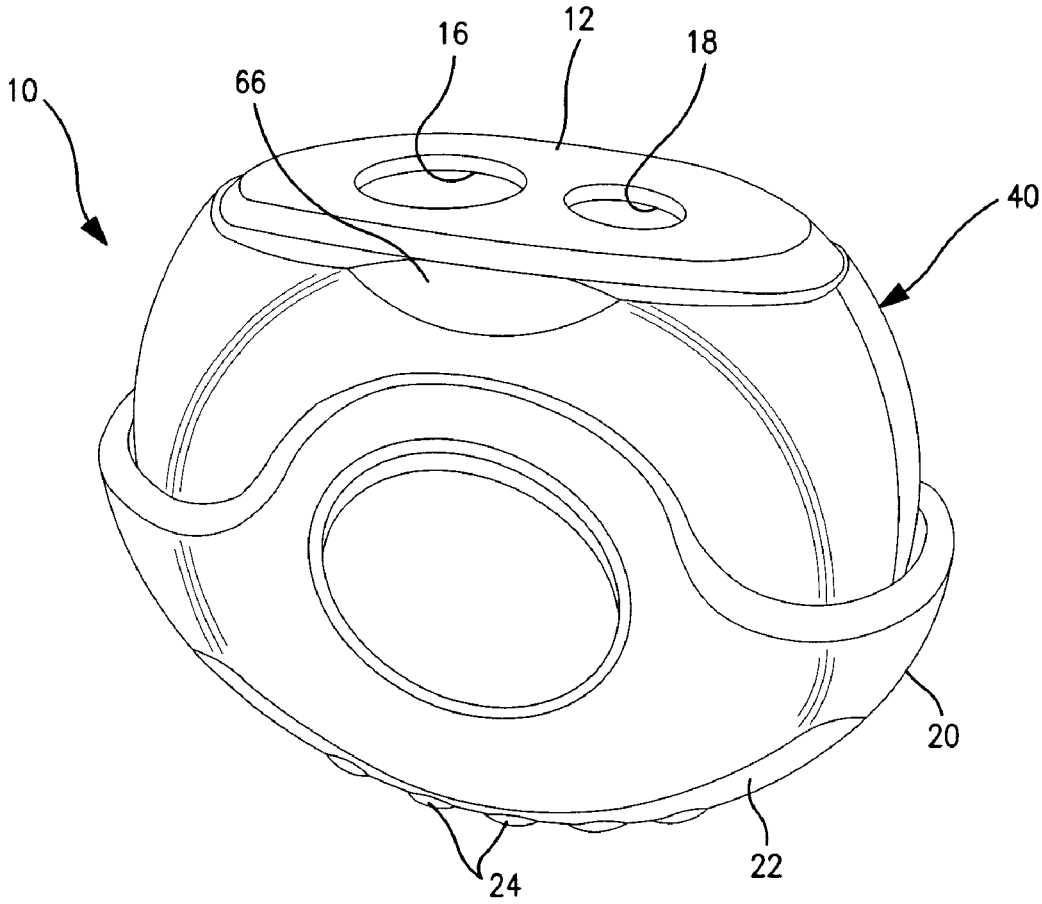
FIG. 5 is a perspective view of the pencil sharpener case of FIG. 1 with the case being in an open position.

With reference to the drawings wherein like numerals represent like parts throughout the several figures, a pencil sharpener case is generally designated by the numeral 10. The pencil sharpener case 10 is a handheld user-friendly device which has a pleasing aesthetic appearance and is relatively compact. In one embodiment, the case 10 has a rounded disk-like shape wherein the dimensions are preferably approximately 60 mm in width and a maximum diameter of approximately 300 mm. The case 10 functions to mount a mechanical pencil sharpener designated generally by the numeral 12 as well as an eraser designated generally by the numeral 14. As may be best appreciated by reference to FIGS. 4 and 5, the pencil sharpener case may be transformed from a closed configuration illustrated in FIG. 4 wherein the eraser 14 is accessible for usage to an open configuration illustrated in FIG. 5 wherein the pencil sharpener 12 may be accessed for usage.

The case 10 comprises a pair of shell members 20 and 40 which cooperate to provide the principal support structure and the housing for the pencil sharpener and the eraser. The sections are rotatably coupled as will be further described below. Shell 40 functions as a base for mounting the pencil sharpener 12 and the eraser 14.

Figure 9:
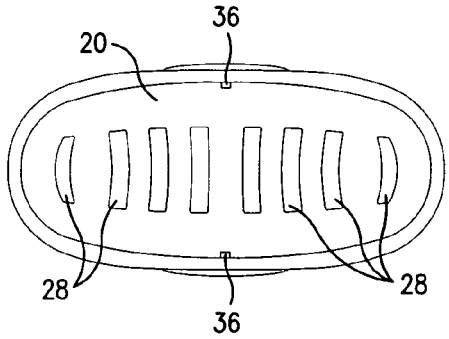
FIG. 9 is an interior view of the cover shell employed in the pencil sharpener case of FIG. 1.

Shell 20 functions as a cover which is rotatably retracted to provide access to the pencil sharpener 12. Shell 20 comprises a rounded quasi-helmet-like shape. The upper portion of the shell includes a soft overmold material 22 with a plurality of ribs 24 which aid in grasping the cover for retraction and re-covering purposes. In one embodiment, the overmold is retained to a plastic structure 26 by means of a plurality of openings in the structure 28 (FIG. 9).

Figure 7:
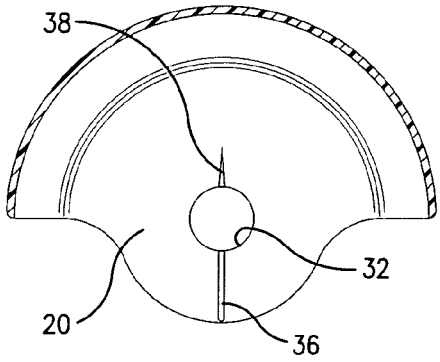
FIG. 7 is an interior view showing a coupling portion of a shell for the case of FIG. 1.

With reference to FIG. 7, at the interior central location on opposed sides of the shell 20 are a pair of apertures 32. These latter structures function to provide the rotatable coupling with the shell 40. A pair of ribs 36 and 38 at the interior extend inwardly to define a pair of angular positions for the shells 20 and 40.

Figure 6:
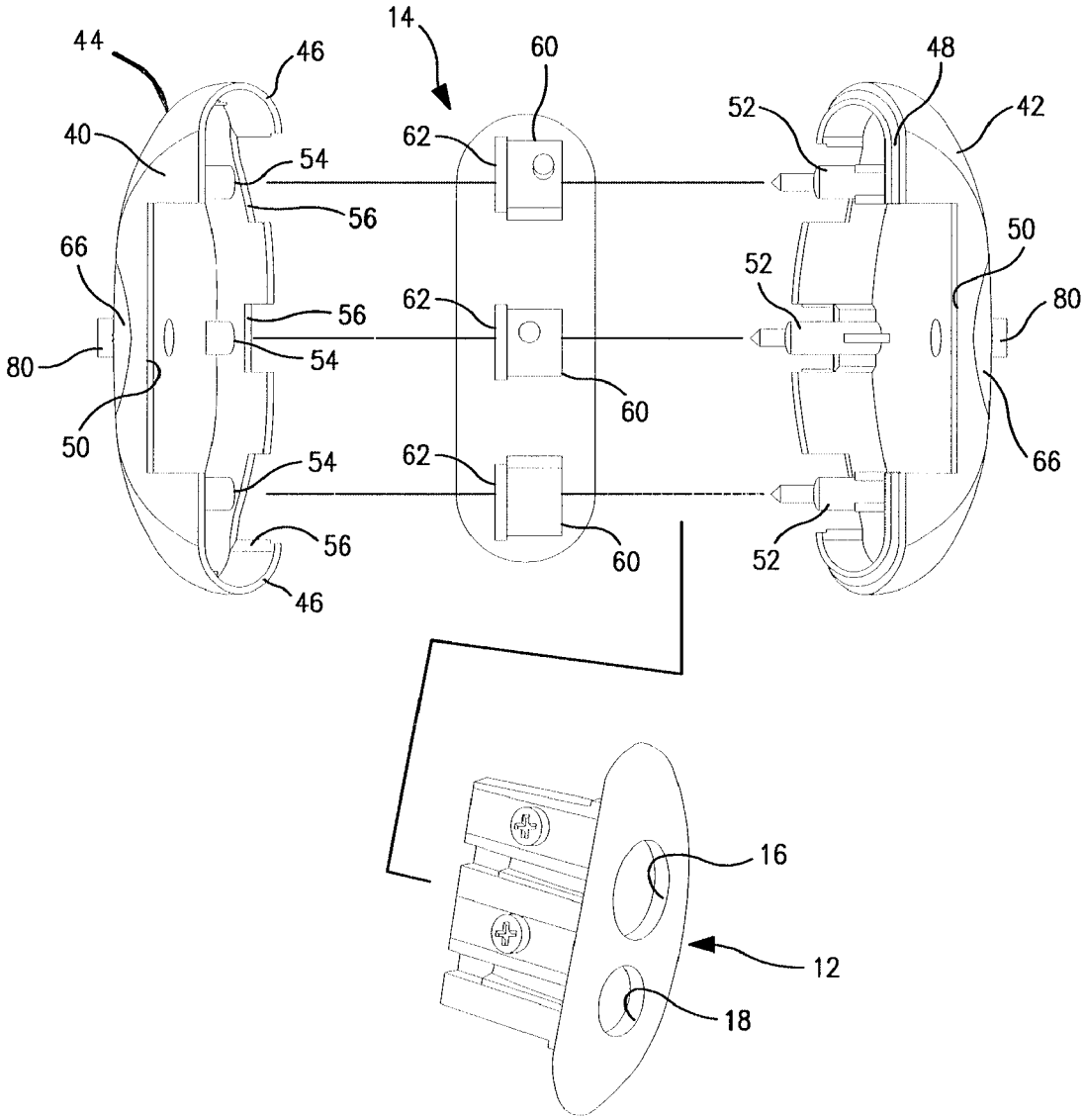
FIG. 6 is an exploded view of a shell for the sharpener case of FIG. 1.
Figure 8:
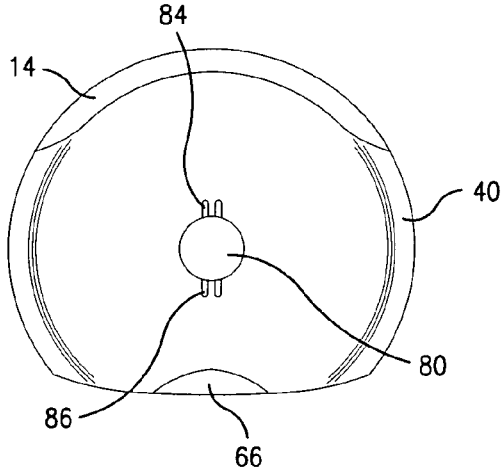
FIG. 8 is an exterior view showing a coupling portion of another shell of the case of FIG. 1 upon disassembly thereof.

With additional reference to FIGS. 6 and 8, shell 40 is preferably formed by two interlocking sections 42 and 44 which interiorly interlock along an extended tab 46 and recess 48 interfaces to cooperatively form a rounded truncated disk-like configuration which, at one side, forms a substantially rectangular opening 50 for receiving the pencil sharpener 12. At the opposing end portion, three coaxially bifurcated posts 52 project outwardly from section 42. Section 44 has three sockets 54 which align with the posts. Adjacent the sockets 54 are corresponding openings 56. The eraser 14 preferably includes spaced extensions 60 which each have a bore 62. The extensions 60 are inserted into the openings 56. The medial portions of the posts 52 traverse through the bores 62. The sockets frictionally interlock with the end of the posts capture the eraser 14 with the shells 42 and 44 and provide a smooth rounded arcuate eraser surface on the shell.

In the illustrated embodiment, the pencil sharpener has two openings 16 and 18 to accommodate different sized pencils. It should be appreciated that, in some embodiments, only a single sharpener opening may be employed for the sharpener.

At the locations adjacent the rectangular openings are a pair of slight indentations 66 to facilitate removal of the pencil sharpener. The interior of the shell 40 functions as a reservoir for the shavings from the sharpening of the pencils. The sharpening is accomplished in a conventional matter by inserting the pencil end to be sharpened and rotating same. When it is desired to remove the shavings, the pencil sharpener 12 is easily grasped (with aid of the indentations 66) and withdrawn from the shell. The shavings are removed and the sharpener is then reinserted into the opening and is retained therein by a snug frictional fit.

Shell sections 42 and 44 each have a projecting axle 80 and form a pair of detents 84 and 86. Each of the axles 80 is received in an aperture 32 of shell 20 in a snap fit-type coupling engagement to rotatably couple the cover shell 20 to the base shell 40. The ribs 36 and 38 on the interior of the cover shell are detainable in detents 84 and 86 on the shell 40 to essentially define two detainably fixed positions of the cover or the shell 20 relative to the shell 40. These two positions correspond to the closed position wherein the eraser 14 is fully accessible for usage and the open position wherein the cover essentially covers the eraser 14 and allows access to the pencil sharpener 12.

What is claimed:

1. A pencil sharpener/eraser comprising:

a first shell comprising a pair of sections which interlock via at least one post and socket and having a generally rounded shape and having a first opening at a first side portion mounting a pencil sharpener so that said pencil sharpener is retained fit to said shell by a snug frictional fit and a generally opposite side portion mounting an eraser and defining a second opening wherein said eraser is retained to said first shell by at least one extension which is traversed by a corresponding one of said at least one post; and a second rounded shell rotatably mounted to said first shell and rotatable from a first position wherein said second shell covers the pencil sharpener and uncovers the eraser to a second position wherein the second shell uncovers the pencil sharpener and covers the eraser;

wherein said first shell defines a reservoir for shavings from said pencil sharpener and said pencil sharpener is slidably removable from said first shell to empty shavings from said reservoir.

2. The pencil sharpener/eraser of claim 1 wherein said pencil sharpener has a pair of openings of different dimensions.

3. The pencil sharpener/eraser of claim 1 wherein one of said first and second shells has a detent and the other of said shells has a catch for detaining said second shell in said first or second position.

4. The pencil sharpener/eraser of claim 2 wherein said first shell defines a pair of indentations adjacent said pencil sharpener.

5. The pencil sharpener/eraser of claim 1 wherein said at least one post and socket comprise three posts and sockets and said at least one extension comprises three extensions.

6. The pencil sharpener/eraser of claim 1 wherein said eraser has a rounded arcuate shape.

7. The pencil sharpener/eraser of claim 1 wherein said second shell has a soft overmold.

8. The pencil sharpener/eraser of claim 1 wherein one shell has a pair of opposing axles and the other shell has a pair of apertures which receive the axles to rotatably couple the shells.

* * * * *

UNITED STATES PATENT AND TRADEMARK OFFICE

CERTIFICATE OF CORRECTION

PATENT NO. : 7,886,395 B2
APPLICATION NO. : 11/899533
DATED : February 15, 2011
INVENTOR(S) : Farnworth et al.

It is certified that error appears in the above-identified patent and that said Letters Patent is hereby corrected as shown below:

Column 3:

Line 17, after "retained" delete "fit".

Signed and Sealed this
Thirty-first Day of May, 2011

David J. Kappos

David J. Kappos
*Director of the United States Patent and Trademark Office*